US006120620A

United States Patent [19]

Benz et al.

[11] Patent Number: 6,120,620

[45] Date of Patent: Sep. 19, 2000

[54] PRASEODYMIUM-RICH IRON-BORON-RARE EARTH COMPOSITION, PERMANENT MAGNET PRODUCED THEREFROM, AND METHOD OF MAKING

[75] Inventors: Mark Gilbert Benz, Burnt Hills; Juliana Ching Shei, Niskayuna, both of N.Y.

[73] Assignee: General Electric Company, Schenectady, N.Y.

[21] Appl. No.: 09/248,951

[22] Filed: Feb. 12, 1999

[51] Int. Cl.[7] ..... H01F 1/053

[52] U.S. Cl. ..... 148/302; 75/244; 75/245; 148/101; 148/103; 419/23; 419/38

[58] Field of Search ..... 148/101, 302, 148/103; 75/244, 245; 419/23, 38

[56] References Cited

U.S. PATENT DOCUMENTS

| | | | |
|---|---|---|---|
| 3,524,800 | 8/1970 | Morrice et al. . | |
| 3,729,397 | 4/1973 | Goldsmith et al. . | |
| 4,597,938 | 7/1986 | Matsuura et al. | 419/23 |
| 4,684,406 | 8/1987 | Matsuura et al. | 75/244 |
| 4,684,448 | 8/1987 | Itoh et al. | 204/71 |
| 4,689,073 | 8/1987 | Nate et al. . | |
| 4,747,924 | 5/1988 | Itoh et al. | 204/225 |
| 4,767,455 | 8/1988 | Jourdan . | |
| 4,837,109 | 6/1989 | Tokunaga et al. | 420/83 |
| 4,865,660 | 9/1989 | Nate et al. | 148/301 |
| 4,875,946 | 10/1989 | Heh et al. | 148/103 |
| 4,975,130 | 12/1990 | Matsuura et al. | 148/302 |
| 4,983,232 | 1/1991 | Endoh et al. | 148/302 |
| 5,022,939 | 6/1991 | Yajima et al. | 148/302 |
| 5,041,172 | 8/1991 | Tokunaga et al. | 148/302 |
| 5,164,023 | 11/1992 | Tabaru et al. | 148/101 |
| 5,178,692 | 1/1993 | Panchanathan | 148/101 |
| 5,223,047 | 6/1993 | Endoh et al. | 148/302 |
| 5,230,751 | 7/1993 | Endoh et al. | 148/302 |
| 5,281,250 | 1/1994 | Hamamura et al. | 74/255 |
| 5,514,224 | 5/1996 | Panchanathan | 95/104 |

FOREIGN PATENT DOCUMENTS

| | | |
|---|---|---|
| 7146 | 8/1990 | China . |
| 1065153 | 10/1992 | China . |

*Primary Examiner*—Ngoclan Mai
*Attorney, Agent, or Firm*—Noreen C. Johnson; Douglas E. Stoner

[57] ABSTRACT

A permanent magnet having substantially stable magnetic properties is disclosed having as the active magnetic component a sintered product of compacted particulate iron-boron-rare earth intermetallic material, said sintered product having pores which are substantially non-interconnecting, a density of at least 87 percent of theoretical and a composition consisting essentially of in atomic percent about 13 to about 19 percent rare earth elements, about 4 to about 20 percent boron and about 61 to about 83 percent of iron with or without impurities; where the rare earth content is greater than 50 percent praseodymium with an effective amount of a light rare earth selected from the group consisting of cerium, lanthanum, yttrium and mixtures thereof, and balance neodymium.

142 Claims, 5 Drawing Sheets

PRASEODYMIUM-RICH IRON-BORON-RARE EARTH COMPOSITION, PERMANENT MAGNET PRODUCED THEREFROM, AND METHOD OF MAKING

BACKGROUND OF THE INVENTION

The present invention relates to permanent magnetic materials and the method of making the permanent magnet. More particularly, the invention relates to high performance sintered intermetallic materials containing an iron-boron-rare earth composition enriched with praseodymium.

Use of high performance permanent magnets of the iron-boron-rare earth type (Fe-B-RE), where RE is a rare earth element containing concentrations of neodymium (Nd) greater than 95%, has become common in the computer and medical industry since the 1980's. For example, computer hardware manufacturers who manufacture small footprint, large capacity computer data storage and retrieval hardware, use very high performance iron-boron-neodymium permanent magnets (the total rare earth being greater than 99 percent Nd). Additionally, medical devices, such as magnetic resonance imaging (MRI) devices, employ vast quantities of permanent magnetic iron-boron-neodymium material, which contain greater than 90 percent of the total rare earth being neodymium. The prevailing practice of manufacturers of high performance permanent magnets of the iron-boron-neodymium type is to utilize 99.9% or higher concentration of pure neodymium as the rare earth component. These magnets achieve intrinsic coercive forces (Hci) in excess of 8 kilo Oested (kOe) and maximum energy products $(BH)_{max}$ in excess of 30 Mega Gauss Oested (MGOe).

Accordingly, due to the sale of these devices with permanent magnets using 90 percent or greater neodymium as the rare earth component, the worldwide demand for neodymium has increased. As a result, the cost of the raw material neodymium has greatly increased. A real need has arisen to develop iron-boron-rare earth magnets of substantially equal performance, which utilize less neodymium to reduce the cost of manufacture of the permanent magnets and the devices which contain the permanent magnets.

Permanent magnets of the Fe-B-RE type, where RE is one or more rare earth elements of which at least 50% of RE is neodymium and/or praseodymium (Pr), are known. U.S. Pat. Nos. 4,684,406 and 4,597,938 teach a high performance magnet consisting of, by atomic percent, (i) 12.5 percent to 20 percent RE wherein RE is at least one rare earth element selected from the group consisting of neodymium, praseodymium, lanthanum, cerium, terbium, dysprosium, holmium, erbium, europium, samarium, gadolinium, promethium, thulium, ytterbium, lutetium and yttrium and at least 50% of RE consists of neodymium and/or praseodymium; (ii) 4 percent to 20 percent boron; and (iii) the balance iron with impurities. Additionally, as may be seen from these patents and U.S. Pat. No. 4,975,130, a method of making the magnet is taught by forming powders of the alloys of the above composition; melting the powders to form an ingot; pulverizing the ingot to form an alloy powder having a mean particle size from 0.3 to 80 microns; compacting the powder at a pressure of 0.5 to 8 Tons/cm$^2$; subjecting the compacted body to a magnetic field of about 7 to 13 kOe; and then sintering at a temperature between 900 to 1,200° C. A permanent magnet prepared in the above fashion specifically comprised of by atomic percent 77Fe-9B-9Nd-5Pr, sintered at 1,120° C. for four hours in an inert atmosphere can acquire a maximum energy product $(BH)_{max}$ of 31.0 MGOe. Likewise, a permanent magnet comprised of by atomic percent 79Fe-7B-14Nd, sintered at 1,120° C. for one hour, can acquire a maximum energy product $(BH)_{max}$ of 33.8 MGOe.

U.S. Pat. No. 4,908,078 shows a rare earth magnet article consisting of the three rare earth elements neodymium-praseodymium-cerium within defined atom ratios of each in the formula: $(Nd_{1-(p+q)}Pr_pCe_q)_xB_yFe_{1-(x+y)}$ wherein $0.1 \leqq x \leqq 0.3$, $0.02 \leqq y \leqq 0.09$, $0.1 \leqq p \leqq 0.3$, and $0.02 \leqq q \leqq 0.15$. Praseodymium is 10 to 30 percent of the total rare earth and cerium is 2 to 15 percent of the rare earth with the balance neodymium. The resultant magnet has a coercive force (Hc) of at least about 5 kOe and a residual magnetic flux density (Br) of at least about 10 kiloGauss (kG). Also, U.S. Pat. No. 5,129,963 discusses rare earth magnet alloys with excellent hot workability having compositions in atomic percent of 10 to 16 percent rare earth elements, 3 to 10 percent boron and about 74 to 87 percent iron (with or without cobalt) where the rare earth elements are neodymium and/or praseodymium plus up to 20 percent of the rare earth is selected from cerium, lanthanum and/or yttrium.

The aforementioned prior art patents fail to disclose or suggest what significance the amount of praseodymium greater than 50 percent of the total rare earth in the presence of cerium, lanthanum, and/or yttrium may have on the magnetic performance of a iron-boron-rare earth magnet. Nor does the prior art teach or suggest in substitution for neodymium, ranges of concentrations of cerium which may form part of the rare earth component with greater than 50% praseodymium that will give equal or better magnetic performance than the iron-boron-neodymium magnets described above. Thus, due to cost and performance considerations, there is a need for a praseodymium-rich permanent magnet of the iron-boron-rare earth type which may further contain other rare earth elements that performs equally or better than the known Fe-B-Nd permanent magnets and which is useful in devices such as magnetic resonance imaging instruments.

SUMMARY OF THE INVENTION

The present invention satisfies this need by providing a sintered intermetallic product comprising compacted and sintered particulate of an iron-boron-rare earth alloy having substantially non-interconnecting pores with a density of at least 87 percent of theoretical and where the alloy further comprises about 13 to about 19 atomic percent rare earth, where the rare earth content consists essentially of greater than 50 percent praseodymium, an effective amount of a light rare earth selected from the group consisting of cerium, lanthanum, yttrium and mixtures thereof, and balance neodymium; about 4 to about 20 atomic percent boron; and balance iron with or without impurities. In this invention, the phrase "praseodymium-rich" means that the rare earth content of the iron-boron-rare earth alloy contains greater than 50% praseodymium. In another aspect of the invention, the percent praseodymium of the rare earth content is at least 70% and can be up to 100% depending on the effective amount of light rare earth present in the total rare earth content. An effective amount of a light rare earth is an amount present in the total rare earth content of the iron-boron-rare earth alloy that allows the magnetic properties to perform equal to or greater than 29 MGOe $(BH)_{max}$ and 6 kOe (Hci). The iron content of the alloy may be present with impurities, such as but not limited to, titanium, nickel, bismuth, cobalt, vanadium, niobium, tantalum, chromium, molybdenum, tungsten, manganese, aluminum, germanium, tin, zirconium, hafnium, and mixtures thereof.

Another embodiment of the invention comprises an isotropic alloy material of an iron-boron-rare earth type consisting essentially of in atomic percent about 13 to about 19 percent rare earth, where said rare earth comprises praseodymium in an amount greater than 50% of the total rare earth, an effective amount of a light rare earth selected from the group consisting of cerium, lanthanum, yttrium and mixtures thereof, and balance neodymium; about 4 to about 20 percent boron; and balance comprising iron with or without impurities.

Still another embodiment is a praseodymium-rich anisotropic permanent magnet of the iron-boron-rare earth type comprising in atomic percent about 13 to about 19 percent rare earth elements, about 4 to about 20 percent boron and about 61 to about 83 percent of iron with or without impurities; where the rare earth content is greater than 50 percent praseodymium with an effective amount of a light rare earth selected from the group consisting of cerium, lanthanum, yttrium and mixtures thereof, and balance neodymium; where the magnet consists essentially of substantially non-interconnecting pores having a density of at least 87 percent theoretical and substantially magnetically aligned grains of $RE_2Fe_{14}B$ tetragonal crystals.

In yet another embodiment, the invention comprises a permanent magnet having substantially stable magnetic properties and having as the active magnetic component a sintered product of compacted particulate iron-boron-rare earth intermetallic material, said sintered product having pores which are substantially non-interconnecting, a density of at least 87 percent of theoretical and a composition consisting essentially of in atomic percent about 13 to about 19 percent rare earth elements, about 4 to about 20 percent boron and about 61 to about 83 percent of iron with or without impurities; where the rare earth content is greater than 50 percent praseodymium with an effective amount of a light rare earth selected from the group consisting of cerium, lanthanum, yttrium and mixtures thereof, and balance neodymium.

The present invention further comprises a sintered permanent magnetic material of the iron-boron-rare earth type made in accordance with the following process, namely: providing an alloy of iron-boron-rare earth in particulate form, said iron, boron, and rare earth being used in amounts substantially corresponding to that desired in the sintered permanent magnetic material and being comprised of a major amount of a iron-boron-rare earth intermetallic phase, pressing and compacting said particulate alloy into a green body, and sintering said green body in a substantially inert atmosphere to produce a sintered permanent magnetic material of the iron-boron-rare earth type having a density of at least 87 percent of theoretical with substantially non-interconnecting pores and a composition consisting essentially of in atomic percent about 13 to about 19 percent rare earth elements, about 4 to about 20 percent boron and about 61 to about 83 percent of iron with or without impurities; where the rare earth content is greater than 50 percent praseodymium with an effective amount of a light rare earth selected from the group consisting of cerium, lanthanum, yttrium and mixtures thereof, and balance neodymium.

The invention further includes a method for making sintered permanent magnet of the iron-boron-rare earth type comprising the steps of: providing an alloy of iron-boron-rare earth in a particulate form where said particulate has a mean particle size of up to 60 microns, wherein the alloy particulate has a composition consisting essentially of, in atomic percent, about 13 to about 19 percent rare earth elements, about 4 to about 20 percent boron and about 61 to about 83 percent of iron with or without impurities; where the rare earth content is greater than 50 percent praseodymium with an effective amount of a light rare earth selected from the group consisting of cerium, lanthanum, yttrium and mixtures thereof, and balance neodymium; pressing and compacting said particulate alloy into a green body; and sintering said green body in a substantially inert atmosphere to produce a sintered permanent magnet having a density of at least about 87 percent of theoretical and consisting essentially of a substantially intermetallic $RE_2Fe_{14}B$ phase which comprises substantially non-interconnecting pores. The pressing of the green body may be carried out in an aligning magnetizing field.

A further embodiment of the invention is a metallic powder having a mean particle size up to about 60 microns comprising a composition consisting essentially of about 13 to about 19 atomic percent rare earth, where the rare earth content consists essentially of greater than 50 percent praseodymium, an effective amount of a light rare earth selected from the group consisting of cerium, lanthanum, yttrium and mixtures thereof, and balance neodymium; about 4 to about 20 atomic percent boron; and balance iron with or without impurities.

DESCRIPTION OF THE INVENTION

Figure 1:
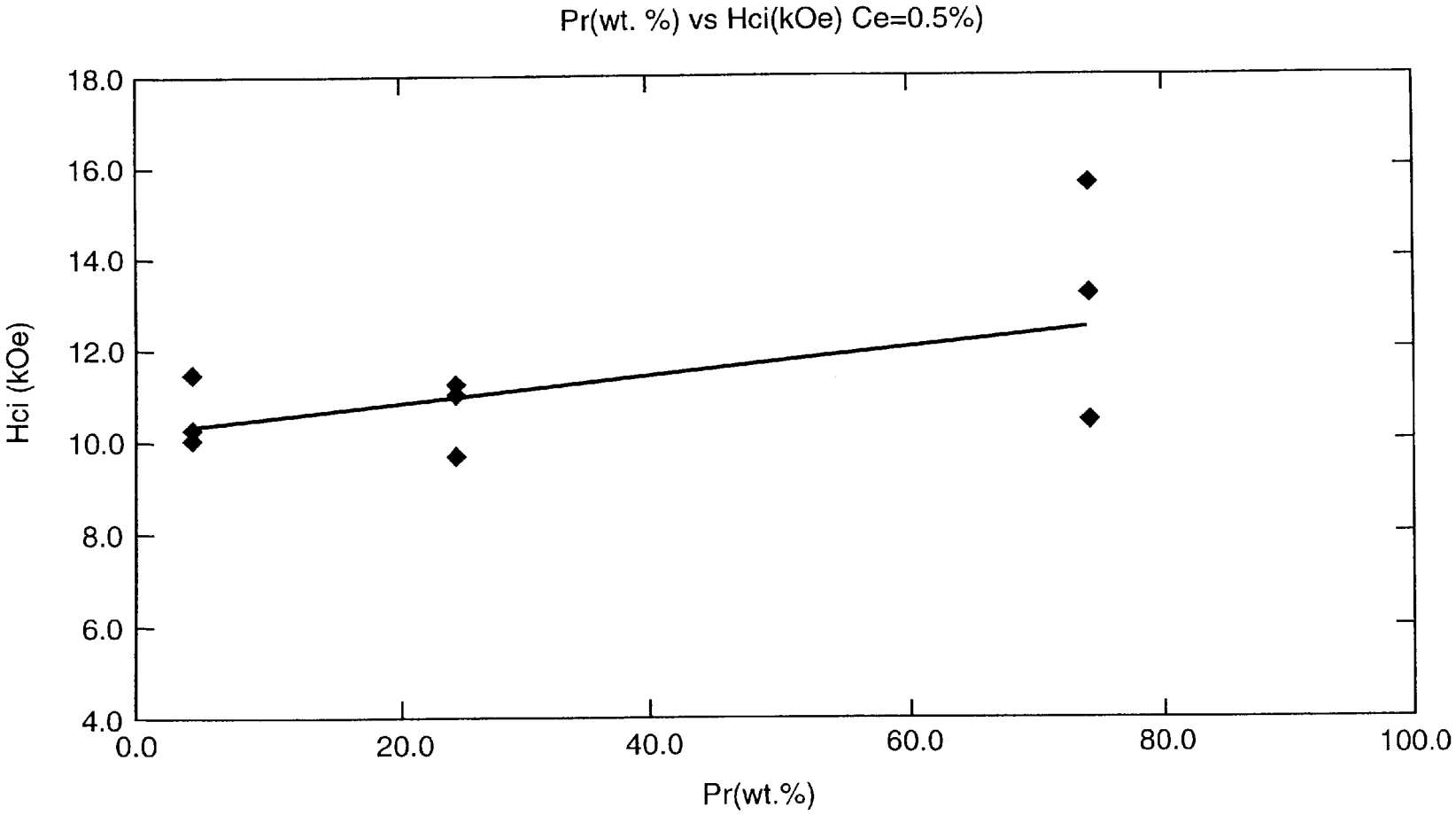
FIG. 1 is a graph showing intrinsic coercive force as a function of praseodymium composition of RE in a Fe-B-RE type magnet, at cerium concentrations of 0.5% of RE.

Surprisingly, one of the discoveries of this invention is that while adding a light rare earth, such as cerium, to an iron-boron-praseodymium permanent magnet, where praseodymium is greater than 50 percent of the total rare earth, the magnetic performance is almost the same as an iron-boron-neodymium magnet, and in some cases the magnetic performance is enhanced. Accordingly, the inventor found that low concentrations of light rare earth, such as cerium, lanthanum and yttrium with the balance of RE consisting essentially of greater than 50 percent praseodymium and the balance neodymium, produce a permanent magnet for magnetic resonance imaging at a reduced cost.

Accordingly, light rare earth refer to cerium, lanthanum and yttrium. For purposes of this invention, praseodymium is the primary rare earth present in the iron-boron-rare earth composition, and thus is not included in the category of light rare earth. With praseodymium always being greater than 50 percent of the total rare earth concentration, the light rare earth (cerium, lanthanum and yttrium) can be up to 30 percent. This is also a quantitative measure of an effective amount of the light rare earth in the overall composition. Preferably, the light rare earth is present up to 10 percent or less, and most preferably up to 5 percent or less. It is further contemplated by this invention that magnet materials or magnets themselves can have up to 1 percent light rare earth with 0.5 percent light rare earth (cerium, lanthanum, yttrium) showing an improvement in the materials' intrinsic coercive force.

The light rare earth can be present individually or in a mixed amount. For instance, only cerium may be present as the light rare earth, or cerium and lanthanum may be present, or a mixture of cerium, lanthanum and yttrium may be present. Likewise, only lanthanum or yttrium may be present, or lanthanum and yttrium, or cerium and yttrium.

As stated, praseodymium is present in the isotropic alloy, the sintered intermetallic product, the anisotropic permanent magnet, and the permanent magnet having stable magnetic properties as greater than 50 percent of the total rare earth content. Sometimes, it might be preferable to have praseodymium present in amounts greater than 70 percent of the total rare earth content, such as in a range between about 70 to 90 percent. Still yet, praseodymium may be included up to 100 percent of the rare earth where there is no substantive amount of light rare earth or neodymium present in the composition.

The compositions of this invention also may include the presence of a trace of heavy rare earth. Heavy rare earths include elements selected from the group consisting of dysprosium, gadolinium, samarium, ytterbium, terbium, holmium and mixtures thereof. A trace amount of heavy rare earth is less than one percent of the total rare earth content, and includes the range between about 0.2 to 0.9 percent.

The overall composition of this invention for an iron-boron-rare earth alloy and magnet is contemplated as comprising in atomic percent, about 13 to about 19 percent rare earth, about 4 to about 20 percent boron, and the balance iron. The formula is represented as $RE_{(13-19)}B_{(4-20)}Fe_{(balance)}$. A more specific formula is demonstrated by 15.5RE-6.5B-78Fe. However, any appropriate formula falling within the ranges specified above for iron, boron and the rare earth is considered part of this invention. It is also contemplated that the iron may or may not include impurities. Examples of such impurities are titanium, nickel, bismuth, cobalt, vanadium, niobium, tantalum, chromium, molybdenum, tungsten, manganese, aluminum, germanium, tin, zirconium, hafnium, and mixtures thereof. The magnetic phase of this material consists of the tetragonal crystalline structure of $RE_2Fe_{14}B$ (in atomic percent).

Isotropic material of the iron-boron-rare earth type is an aspect of the invention. This material is sometimes referred to as alloy or alloy material. Generally, it comprises in atomic percent, about 13 to about 19 percent rare earth, about 4 to about 20 percent boron, and the balance iron in particulate form or as an ingot. In forming the isotropic material (alloy), the iron, boron, and rare earth metal are each used in amounts substantially corresponding to those desired in the final sintered product. The alloy can be formed by a number of methods. For example, it can be prepared by arc-melting or induction melting the iron, boron and rare earth metal together in the proper amounts under a substantially inert atmosphere such as argon and allowing the melt to solidify. Preferably the melt is cast into an ingot.

If the isotropic material (alloy) exists as an ingot, then it can be converted to particulate form in a conventional manner known by those skilled in the art. The ingot undergoes a crushing or pulverizing step in order to form the particulate material. Such conversion can be carried out in air at room temperature. For example, the isotropic material can be crushed by mortar and pestle and then pulverized to a finer form by jet milling. Such powder may also be produced by known ball milling procedures, or Alpine jet milling. The particle size of the iron-boron-rare earth alloy of the present invention may vary. It can be as finely divided as desired. The alloy particulate can have a mean particle size up to 60 microns. For most applications, average particle size will range from about 1 to about 10 microns, or about 1 to about 7 microns, or about 3 to about 5 microns. It may be unusual, but the particulate material can even be up to 100 microns. While larger sized particles can be used, it is pointed out that as the particle size is increased, the maximum coercive force obtainable is lower because the coercive force generally varies inversely with particle size. In addition, the smaller the particle size, the lower is the sintering temperature which may be used.

The isotropic material (alloy) exists prior to the application of a magnetic field. Once a magnetic field is applied, then particulate grains align themselves magnetically so that the principal magnetic phase is $RE_2Fe_{14}B$ and the grains magnetically align along their easy axis. If the isotropic particulate (alloy) is exposed to an aligning magnetic field, it generally occurs before pressing and compacting the particulate into a green body, which is subsequently sintered. The aligning magnetic field may also be applied during the pressing and compacting of the isotropic particulate. The magnetic field that is applied is at least 7kOe and may range between about 10 to about 30. The greater the magnetic alignment of the particulate grains (also referred to herein as particles), the better the resulting magnetic properties.

The particulate material (alloy) can be compressed or compacted into a green body of the desired size and density by any of a number of techniques know to those skilled in the art. Some of these techniques include hydrostatic pressing or methods employing steel dies. Preferably, compression is carried out to produce a green body with as high a density as possible, since the higher its density, the greater the sintering rate. Green bodies having a density of about fifty percent or higher of theoretical are recommended.

The green body is sintered to produce a sintered intermetallic product of desired density. Preferably, the green body is sintered to produce a sintered intermetallic product wherein the pores are substantially non-interconnecting. Such non-interconnectivity stabilizes the permanent magnet properties of the product because the interior of the sintered intermetallic product or magnet is protected against exposure to the ambient atmosphere.

The sintering temperature used in the invention depends largely on the alloy composition $RE_{(13-19)}B_{(4-20)}Fe_{(balance)}$ that is selected and the particle size. The minimum sintering temperature must be sufficient for sintering to occur in the selected alloy composition and it must be high enough to coalesce the particles. Sintering is carried out so that the pores in the sintered intermetallic product are substantially non-interconnecting. A sintered intermetallic product having a density of at least about 87 percent of theoretical is generally one wherein the pores are substantially non-interconnecting. Non-interconnectivity can be determined by standard metallographic techniques, such as optical electron micrographs of a cross-section of the sintered product. The maximum sintering temperature is usually one at which significant growth of the particles or grains does not occur, since too large an increase in grain size deteriorates magnetic properties such as coercive force. The green body is sintered in a substantially inert atmosphere such as argon, and upon completion of sintering, the body can be cooled to room temperature in a substantially inert atmosphere.

A particular sintering range for a selected composition can be determined empirically, as for example, carrying out a series of runs at successively higher sintering temperatures and then determining the magnetic properties of the sintered intermetallic products. The sintering temperature may be in the range of about 950 to about 1200° C. for most compositions of this invention. The sintering time varies but may lie between one and five hours.

The density of the sintered intermetallic product may vary. The particular density depends largely on the particular permanent magnet properties desired. Preferably, to obtain a product with substantially stable permanent magnet properties, the density of the sintered intermetallic product should be one wherein the pores are substantially non-interconnecting and this occurs usually at a density of about 87 percent or greater. However, for some applications, the density may be below 87 percent, such as the range from about 80 percent up to 100 percent. For example, at low temperature applications, a sintered intermetallic product having a density ranging down to about 80 percent may be satisfactory. The preferred density of the sintered intermetallic product is one which is the highest obtainable without producing a growth in grain size which would deteriorate magnetic properties significantly, since the higher the density the better are the magnetic properties. For iron-boron-rare earth sintered intermetallic products of the present invention, a density of at least about 87 percent of theoretical, i.e. of full density, and as high as about 96 percent of theoretical is preferred to produce permanent magnets with suitable magnetic properties which are substantially stable.

In the present invention, at sintering temperature as well as at room temperatures, the final sintered intermetallic product contains a major amount of the $RE_2Fe_{14}B$ solid intermetallic phase. A major amount is greater than 50 percent by weight of the intermetallic product. Traces of other iron-boron-rare earth intermetallic phases may also be present. Sintered intermetallic products having the highest energy products are those having the smallest content of other iron-boron-rare earth intermetallic phases. The preferred final sintered intermetallic product is comprised predominately of the $RE_2Fe_{14}B$ solid intermetallic phase, i.e. about 95 percent by weight or higher but less than 100 percent.

Sintering of the green body produces a sintered product which weighs about the same as the green body indicating no loss, or no significant loss of iron, boron, and rare earth components. Standard chemical analysis of a sintered product should show that the rare earth and iron and boron content is substantially unaffected by the sintering process.

Magnetization of the present sintered intermetallic products of iron, boron and rare earth produces novel permanent magnets. The magnetic properties of the present sintered intermetallic products can be improved by subjecting them to a heat-aging process. The sintered intermetallic product is heat-aged at a temperature within 400° C. below its sintering temperature and preferably within 300 to 100° C. below its sintering temperature. Heat-aging is carried out in an atmosphere such as argon in which the material is substantially inert. The particular temperature at which the material is heat-aged is determinable empirically. For example, the sintered product may be initially magnetized and its magnetic properties determined. It is then heated at a temperature below its sintering temperature, generally about 100° C. below its sintering temperature for a period of time, for example about 3 hours or longer, and thereafter, allowed to cool to room temperature and magnetized in the same manner and its magnetic properties determined. This procedure may be repeated at successively lower temperatures until a temperature is found at which the magnetic properties, i.e. intrinsic and/or normal coercive force, of the product show a marked improvement. The product can then be further aged at such temperature to increase the coercive force. Once the particular heat-aging temperature is determined for a particular system, the sintered product can be heat-aged immediately after sintering, if desired, simply by lowering the furnace temperature, i.e. furnace cooling, to the desired heat-aging temperature.

Heat-aging by furnace cooling to the desired aging temperature is preferred. It requires a shorter period of time and generally produces a product with an intrinsic and/or normal coercive force significantly higher than that produced by the technique of initially cooling the sintered product to room temperature and then heating it up to the proper heat-aging temperature. For best results, the rate of furnace cooling should be slow with the particular furnace cooling rate being determinable empirically. Preferably, the furnace cooling rate may range from about 0.1 to about 20° C. per minute depending largely on the particular iron-boron-rare earth alloy used. In addition, the rate of furnace cooling may be carried out in a continuous manner or, if desired, by step cooling.

When magnetized, the heat-aged sintered intermetallic product of the present invention is useful as a permanent magnet. The resulting permanent magnet is substantially stable in air and has a wide variety of uses. For example, the permanent magnets of the present invention are useful in magnetic resonance imaging devices.

If desired, the sintered bulk intermetallic product of the present invention can be crushed to a desired particle size preferably a powder, which is particularly suitable for alignment and matrix bonding to give a stable permanent magnet.

Based on the method steps above, permanent magnet materials of the iron-boron-rare earth type of this invention may then be obtained having intrinsic coercive force (Hci) values of at least 6 kOe, and more likely above 8 kOe. The corresponding maximum energy product values $(BH)_{max}$ are at least 29 MGOe, and more likely above 35 MGOe. Table 1 shows samples created using the above methods, without heat-aging, which correspond to the compositions of this invention consisting of 78Fe-6.5B-15.5RE including the light rare earth cerium in the total rare earth content.

Because cerium typically occurs naturally in combination with neodymium or praseodymium, and to further obtain a cost advantage of such magnets by reducing the concentration of neodymium, permanent magnet compositions of the $RE_{(13-19)}B_{(4-20)}Fe_{(balance)}$ type having various concentrations of cerium are demonstrated. Table 1 sets out the intrinsic coercive force and the maximum energy product results for 35 samples of $RE_{(13-19)}B_{(4-20)}Fe_{(balance)}$ type permanent magnets, where the composition of the rare earth is varied by utilizing various ratios of cerium, praseodymium and neodymium. For each of the 35 $RE_{(13-19)}B_{(4-20)}Fe_{(balance)}$ permanent magnet samples, the atomic percentages of the alloy composition for each sample were 78Fe-6.5B-15.5RE.

TABLE I

| Test Sample | Pr (wt % of R) | Ce (wt % of R) | Nd (wt % of R) | iHc (kOe) | $(BH)_{max}$ (MGPOe) |
|---|---|---|---|---|---|
| B1-1 | 24.9 | 0.5 | 74.6 | 11.1 | 40.9 |
| B1-2 | 24.9 | 0.5 | 74.6 | 11.3 | 37.7 |
| B1-3 | 24.9 | 0.5 | 74.6 | 9.7 | 41.2 |

TABLE I-continued

| Test Sample | Pr (wt % of R) | Ce (wt % of R) | Nd (wt % of R) | iHc (kOe) | $(BH)_{max}$ (MGPOe) |
|---|---|---|---|---|---|
| B2-1 | 24.0 | 4.0 | 72.0 | 9.5 | 36.5 |
| B2-2 | 24.0 | 4.0 | 72.0 | 9.3 | 37.9 |
| B2-3 | 24.0 | 4.0 | 72.0 | 9.8 | 38.0 |
| B3-1 | 22.5 | 10.0 | 67.5 | 5.8 | 29.6 |
| B3-2 | 22.5 | 10.0 | 67.5 | 6.2 | 31.3 |
| B3-3 | 22.5 | 10.0 | 67.5 | 6.1 | 28.0 |
| B4-1 | 4.5 | 0.5 | 95.0 | 10.0 | 39.2 |
| B4-2 | 4.5 | 0.5 | 95.0 | 10.3 | 37.5 |
| B4-3 | 4.5 | 0.5 | 95.0 | 10.3 | 41.2 |
| B5-1 | 74.6 | 0.5 | 24.9 | 13.3 | 39.0 |
| B5-2 | 74.6 | 0.5 | 24.9 | 10.5 | 40.2 |
| B5-3 | 74.6 | 0.5 | 24.9 | 10.5 | 39.3 |
| E0 | 0.0 | 0.0 | 100.0 | 11.1 | 36.2 |
| E1 | 24.9 | 0.5 | 74.6 | 11.2 | 32.0 |
| E2 | 24.0 | 4.0 | 72.0 | 10.0 | 32.8 |
| E3 | 22.5 | 10.0 | 67.5 | 5.8 | 29.9 |
| E4 | 4.5 | 0.5 | 95.0 | 11.5 | 34.0 |
| E5 | 74.6 | 0.5 | 24.9 | 15.7 | 30.6 |
| E6 | 48.6 | 5.3 | 46.1 | 9.5 | 30.0 |
| E7 | 53.8 | 4.3 | 41.9 | 11.7 | 30.5 |
| E-A | 50.0 | 10.0 | 40.0 | 6.6 | 28.8 |
| E-B1 | 60.0 | 0.0 | 40.0 | 11.7 | 37.6 |
| E-B2 | 60.0 | 0.0 | 40.0 | 12.1 | 37.3 |
| E-C1 | 90.0 | 10.0 | 0.0 | 7.7 | 28.5 |
| E-C2 | 90.0 | 10.0 | 0.0 | 7.2 | 29.1 |
| E-D1 | 100.0 | 0.0 | 0.0 | 9.8 | 32.8 |
| E-D2 | 100.0 | 0.0 | 0.0 | 10.7 | 32.0 |
| E-AB1 | 55.0 | 5.0 | 40.0 | 7.9 | 33.1 |
| E-AB2 | 55.0 | 5.0 | 40.0 | 9.0 | 32.6 |
| E-AB2 | 55.0 | 5.0 | 40.0 | 9.0 | 32.6 |
| E-CD1 | 95.0 | 5.0 | 0.0 | 9.0 | 30.7 |
| E-CD2 | 95.0 | 5.0 | 0.0 | 9.3 | 30.5 |
| E-ABCD | 75.0 | 5.0 | 20.0 | 7.7 | 33.2 |

Analysis of the data set out in Table 1 produced a surprising result. In particular, plots of the intrinsic coercive force (Hci) as a function of praseodymium (wt. %), where the cerium amount is kept approximately constant, generally tend to show an increase in magnetic performance Hci as the percentage of praseodymium was increased for ranges of cerium concentrations at 0.5% and 10% (see FIGS. 1 and 3).

Figure 2:
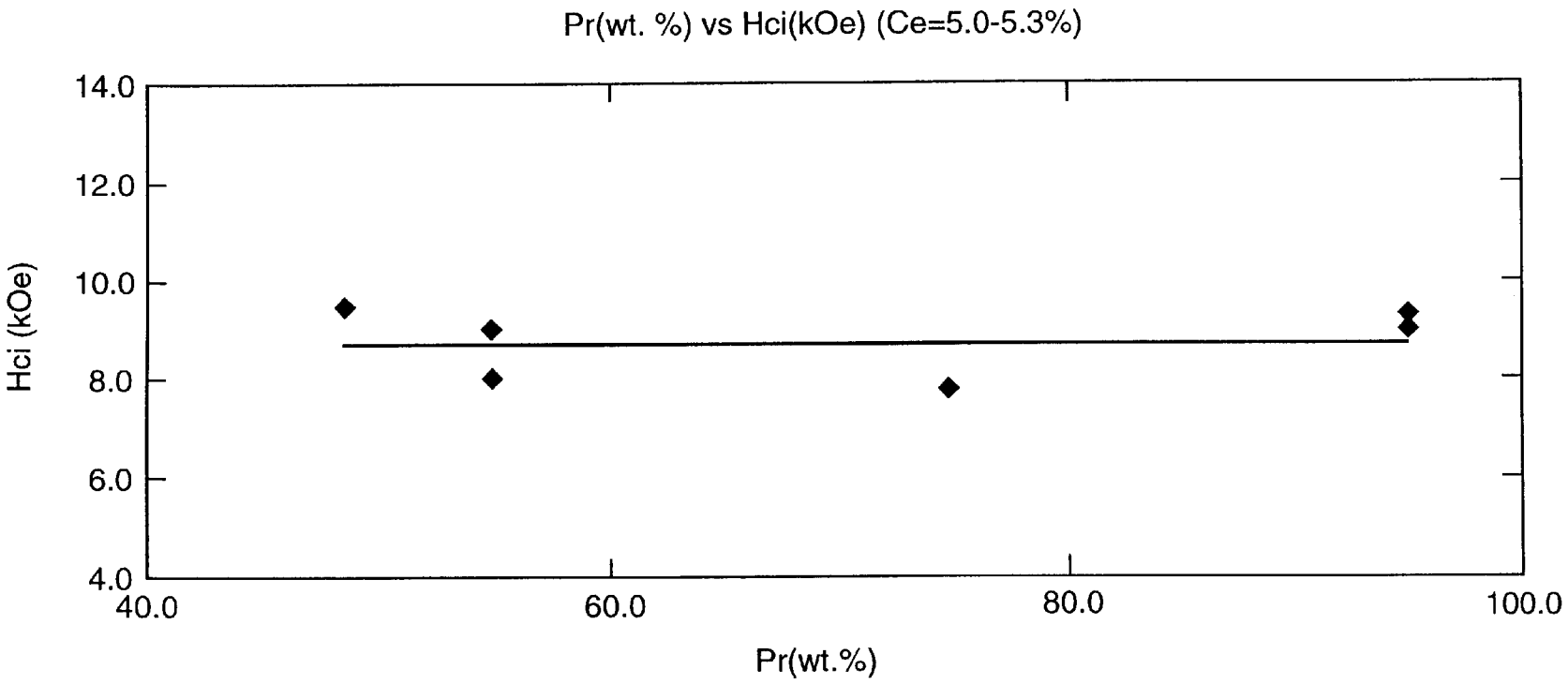
FIG. 2 is a graph showing intrinsic coercive force as a unction of praseodymium composition of RE in a Fe-B-RE type magnet, at cerium concentrations of 5.0–5.3% of RE.
Figure 3:
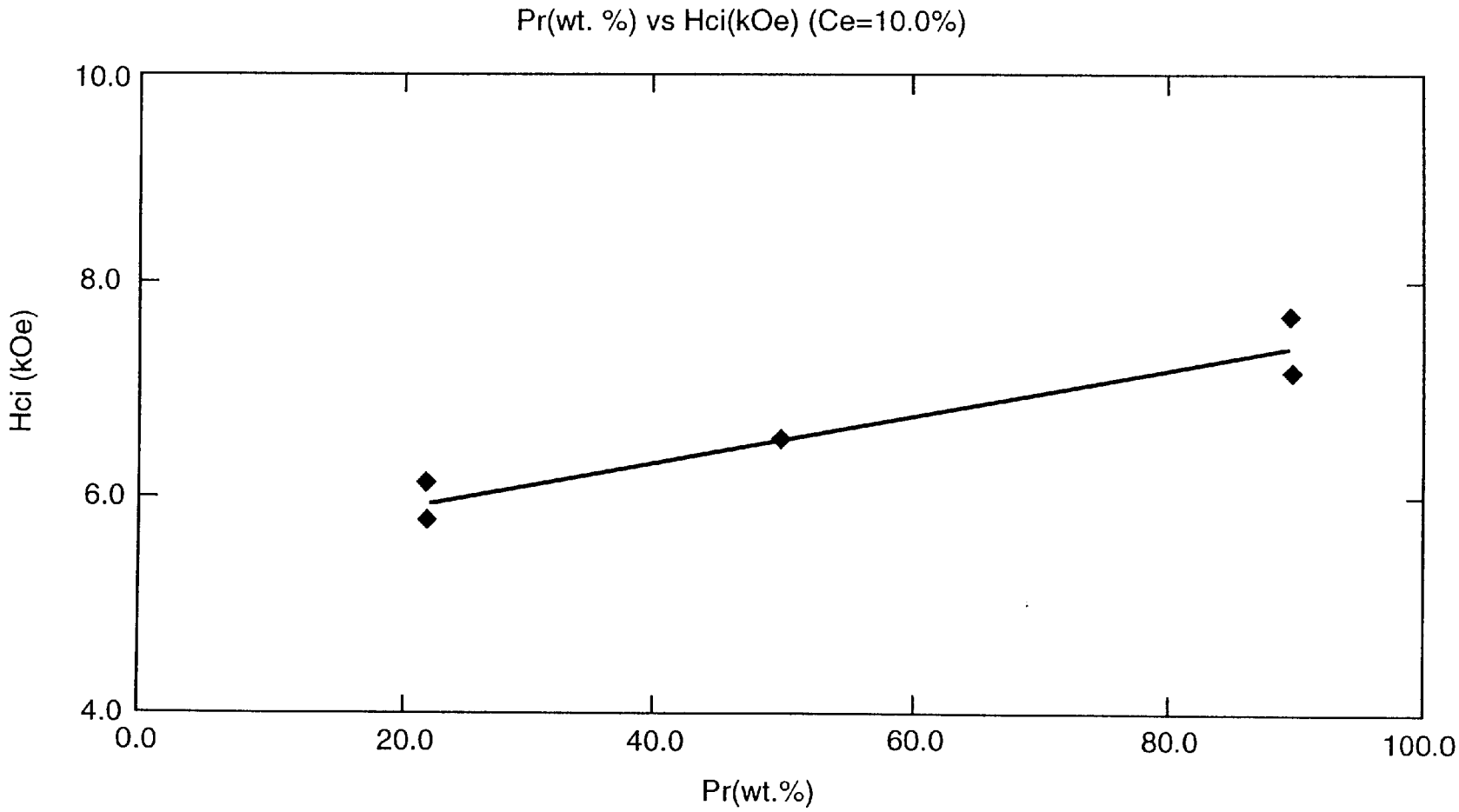
FIG. 3 is a graph showing intrinsic coercive force as a function of praseodymium composition of RE in a Fe-B-RE type magnet, at cerium concentrations of 10% of RE.

Now turning to the figures, FIGS. 1, 2, and 3 show a plot of the magnetic performance of the sample, as measured by Hci, as a function of praseodymium addition, for ranges of cerium equals about 0.5% (FIG. 1), cerium equals about 5.0–5.3% (FIG. 2), and cerium equals about 10% (FIG. 3). For cerium equals 5.0–5.3% (FIG. 2), substituting praseodymium for neodymium and increasing the praseodymium up to 95% of the total rare earth content, has no adverse effect on Hci. Increasing the praseodymium concentration up to about 90% at cerium levels of about 10% (FIG. 3) and cerium levels of about 0.5% (FIG. 1) has on the average a positive effect on Hci.

Figure 4:
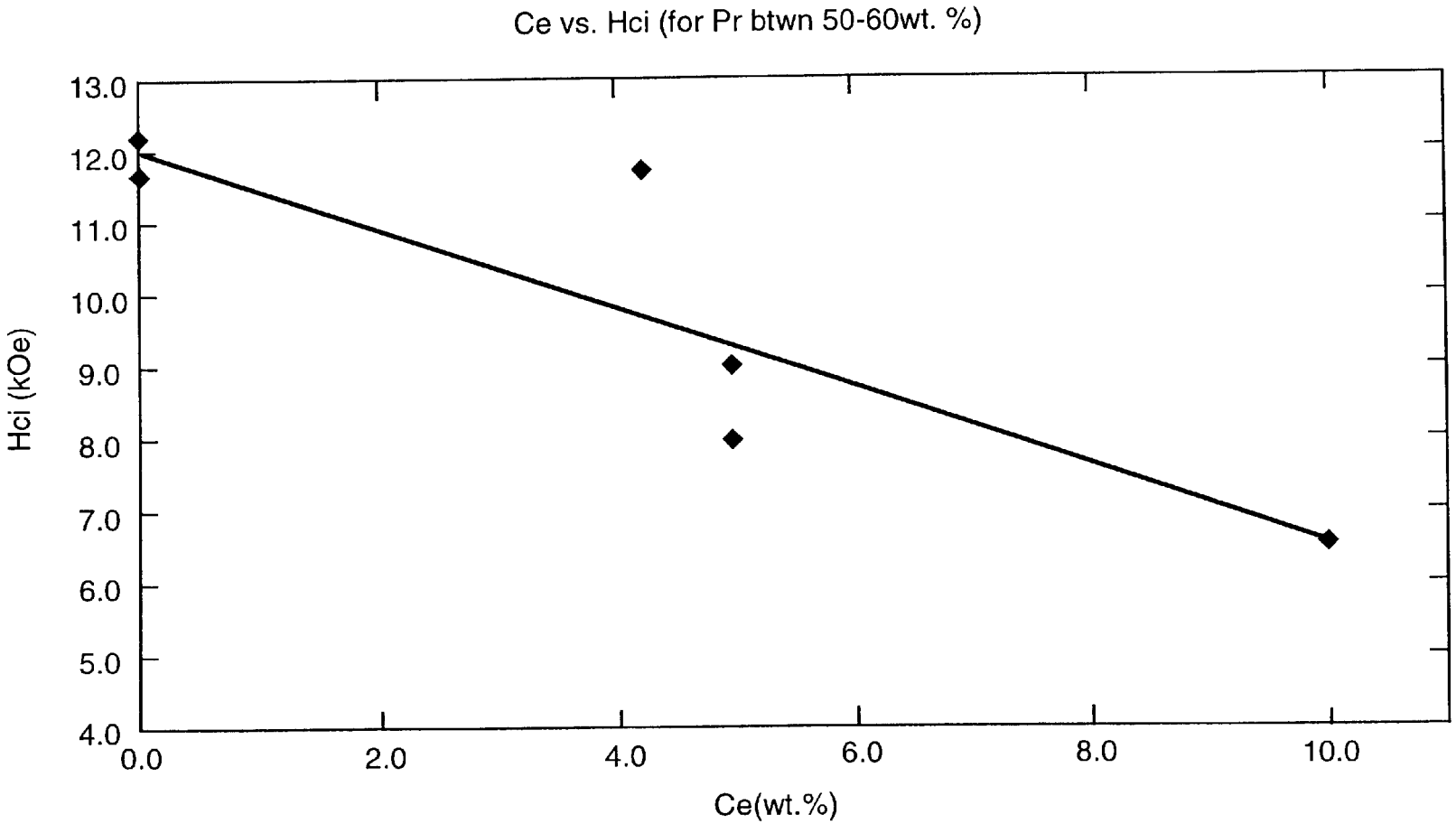
FIG. 4 is a graph plotting intrinsic coercive force as a function of cerium concentration of RE at praseodymium concentrations between 50–60% of RE.
Figure 5:
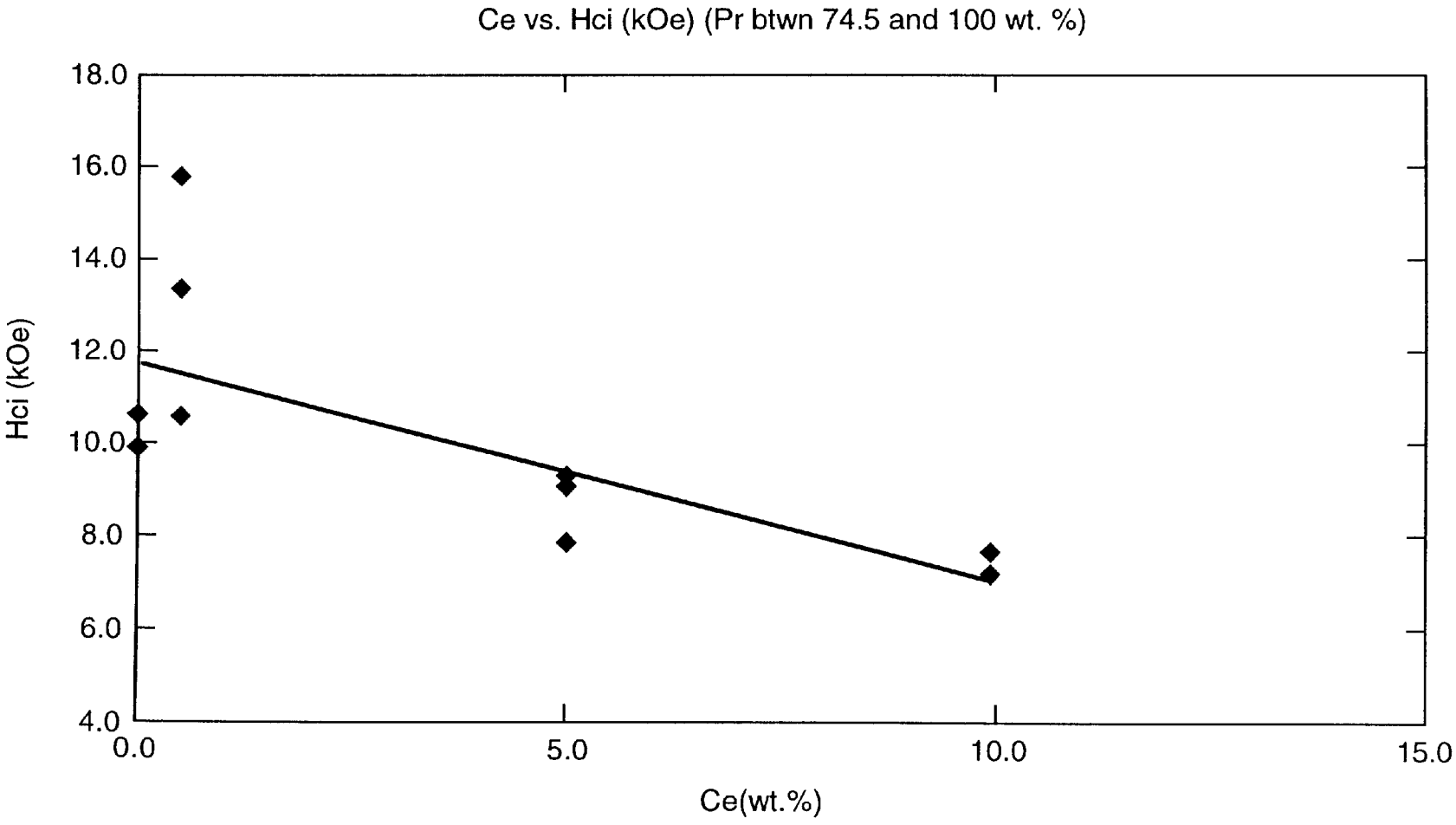
FIG. 5 is a graph plotting intrinsic coercive force as a function of cerium concentration of RE at praseodymium concentrations between 74.5–100% of RE.

FIG. 4 shows a plot of magnetic performance Hci as a function of cerium addition, at relatively constant values of praseodymium (from greater than 50 to 60 wt. %). FIG. 5 likewise shows a plot of magnetic performance Hci as a function of cerium addition, at relatively constant values of praseodymium (from about 75 to 100 wt. %).

While there have been described herein what are considered to be preferred and exemplary embodiments of the present invention, other modifications of the invention will be apparent to those skilled in the art from the teachings herein.

What is claimed is:

1. A sintered intermetallic product comprising compacted and sintered particulate of an iron-boron-rare earth alloy having substantially non-interconnecting pores with a density of at least 87 percent of theoretical and where the alloy further comprises about 13 to about 19 atomic percent rare earth, where the rare earth content consists essentially of greater than 50 percent praseodymium, an effective amount of light rare earth selected from the group consisting of cerium, lanthanum, yttrium and mixtures thereof, and balance neodymium; about 4 to about 20 atomic percent boron; and balance iron with or without impurities.

2. The sintered intermetallic product of claim 1 where the light rare earth is cerium.

3. The sintered intermetallic product of claim 2 where the cerium is present in an amount up to about 10.0 percent of the total rare earth content.

4. The sintered intermetallic product of claim 3 where the cerium is present in an amount up to about 5.0 percent of the total rare earth content.

5. The sintered intermetallic product of claim 4 where the cerium is present in an amount less than one percent of the total rare earth content.

6. The sintered intermetallic product of claim 1 where the light rare earth is a mixture of cerium and lanthanum.

7. The sintered intermetallic product of claim 6 where the mixture of cerium and lanthanum is up to about 10 percent of the total rare earth content.

8. The sintered intermetallic product of claim 1 where the light rare earth is lanthanum.

9. The sintered intermetallic product of claim 8 where the lanthanum is present in an amount up to about 10.0 percent of the total rare earth content.

10. The sintered intermetallic product of claim 9 where the lanthanum is present in an amount up to about 5.0 percent of the total rare earth content.

11. The sintered intermetallic product of claim 10 where the lanthanum is present in an amount less than one percent of the total rare earth content.

12. The sintered intermetallic product of claim 1 where the light rare earth is yttrium.

13. The sintered intermetallic product of claim 12 where the yttrium is present in an amount up to about 10.0 percent of the total rare earth content.

14. The sintered intermetallic product of claim 13 where the yttrium is present in an amount up to about 5.0 percent of the total rare earth content.

15. The sintered intermetallic product of claim 14 where the yttrium is present in an amount less than one percent of the total rare earth content.

16. The sintered intermetallic product of claim 1 where the praseodymium is present in an amount greater than 70 percent of the total rare earth content.

17. The sintered intermetallic product of claim 16 where the praseodymium is present in an amount between about 70 to about 90 percent of the total rare earth content.

18. The sintered intermetallic product of claim 1 where the mixture of cerium, lanthanum and yttrium is up to about ten percent of the total rare earth content.

19. The sintered intermetallic product of claim 1 where heavy rare earth elements are present in a trace amount less than one percent of the total rare earth content.

20. The sintered intermetallic product of claim 19 where the heavy rare earth elements are selected from the group consisting of dysprosium, gadolinium, samarium, ytterbium, terbium, holmium and mixtures thereof.

21. The sintered intermetallic product of claim 1 where the impurities present with iron comprise at least one selected from the group consisting of titanium, nickel, bismuth, cobalt, vanadium, niobium, tantalum, chromium, molybdenum, tungsten, manganese, aluminum, germanium, tin, zirconium, hafnium, and mixtures thereof.

22. The sintered intermetallic product of claim 1 having an intermetallic phase with the tetragonal crystalline structure of $RE_2Fe_{14}B$.

23. The sintered intermetallic product of claim 1 having a maximum energy product of at least 29 MGOe and an intrinsic coercive force of at least 6 kOe.

24. The sintered intermetallic product of claim 1 where the maximum energy product is greater than 35 MGOe and the intrinsic force is greater than or equal to 8 kOe.

25. An isotropic alloy material of an iron-boron-rare earth alloy consisting essentially of in atomic percent about 13 to about 19 percent rare earth, where said rare earth comprises praseodymium in an amount greater than 50% of the total rare earth, an effective amount of a light rare earth selected from the group consisting of cerium, lanthanum, yttrium and mixtures thereof, and balance neodymium; about 4 to about 20 percent boron; and balance comprising iron with or without impurities.

26. The isotropic alloy material of claim 25 where the light rare earth is cerium.

27. The isotropic alloy material of claim 26 where the cerium is present in an amount up to about 10.0 percent of the total rare earth content.

28. The isotropic alloy material of claim 27 where the cerium is present in an amount up to about 5.0 percent of the total rare earth content.

29. The isotropic alloy material of claim 28 where the cerium is present in an amount less than one percent of the total rare earth.

30. The isotropic alloy material of claim 25 where the light rare earth is a mixture of cerium and lanthanum.

31. The isotropic alloy material of claim 30 where the mixture of cerium and lanthanum is up to about 10 percent of the total rare earth content.

32. The isotropic alloy material of claim 25 where the light rare earth is lanthanum.

33. The isotropic alloy material of claim 32 where the lanthanum is present in an amount up to about 10.0 percent of the total rare earth content.

34. The isotropic alloy material of claim 33 where the lanthanum is present in an amount up to about 5.0 percent of the total rare earth content.

35. The isotropic alloy material of claim 34 where the lanthanum is present in an amount less than one percent of the total rare earth content.

36. The isotropic alloy material of claim 25 where the light rare earth is yttrium.

37. The isotropic alloy material of claim 36 where the yttrium is present in an amount up to about 10.0 percent of the total rare earth content.

38. The isotropic alloy material of claim 37 where the yttrium is present in an amount up to about 5.0 percent of the total rare earth content.

39. The isotropic alloy material of claim 38 where the yttrium is present in an amount less than one percent of the total rare earth content.

40. The isotropic alloy material of claim 25 where the praseodymium is present in an amount greater than 70 percent of the total rare earth content.

41. The isotropic alloy material of claim 40 where the praseodymium is present in an amount between about 70 to about 90 percent of the total rare earth content.

42. The isotropic alloy material of claim 25 where the mixture of cerium, lanthanum and yttrium is up to about ten percent of the total rare earth content.

43. The isotropic alloy material of claim 25 where heavy rare earth elements are present in a trace amount less than one percent of the total rare earth content.

44. The isotropic alloy material of claim 43 where the heavy rare earth elements are selected from the group consisting of dysprosium, gadolinium, samarium, ytterbium, terbium, holmium and mixtures thereof.

45. The isotropic alloy material of claim 25 where the impurities present with iron comprise at least one selected from the group consisting of titanium, nickel, bismuth, cobalt, vanadium, niobium, tantalum, chromium, molybdenum, tungsten, manganese, aluminum, germanium, tin, zirconium, hafnium, and mixtures thereof.

46. The isotropic alloy material of claim 25 having an intermetallic phase with the tetragonal crystalline structure of $RE_2Fe_{14}B$.

47. A praseodymium-rich anisotropic permanent magnet of the iron-boron-rare earth alloy comprising in atomic percent about 13 to about 19 percent rare earth element or elements, about 4 to about 20 percent boron, and about 61 to about 83 percent of iron with or without impurities; where the rare earth content is greater than 50 percent praseodymium with an effective amount of a light rare earth selected from the group consisting of cerium, lanthanum, yttrium and mixtures thereof, and balance neodymium; where the magnet consists essentially of substantially non-interconnecting pores having a density of at least 87 percent theoretical and substantially magnetically aligned grains of $RE_2Fe_{14}B$ tetragonal crystals.

48. The praseodymium-rich anisotropic permanent magnet of claim 47 where the light rare earth is cerium.

49. The praseodymium-rich anisotropic permanent magnet of claim 48 where the cerium is present in an up to about 10.0 percent of the total rare earth content.

50. The praseodymium-rich anisotropic permanent magnet of claim 49 where the cerium is present in an amount up to about 5.0 percent of the total rare earth content.

51. The praseodymium-rich anisotropic permanent magnet of claim 50 where the cerium is present in an amount less than one percent of the total rare earth.

52. The praseodymium-rich anisotropic permanent magnet of claim 47 where the light rare earth is a mixture of cerium and lanthanum.

53. The praseodymium-rich anisotropic permanent magnet of claim 52 where the mixture of cerium and lanthanum is up to about 10 percent of the total rare earth content.

54. The praseodymium-rich anisotropic permanent magnet of claim 47 where the light rare earth is lanthanum.

55. The praseodymium-rich anisotropic permanent magnet of claim 54 where the lanthanum is present in an amount up to about 10.0 percent of the total rare earth content.

56. The praseodymium-rich anisotropic permanent magnet of claim 55 where the lanthanum is present in an amount up to about 5.0 percent of the total rare earth content.

57. The praseodymium-rich anisotropic permanent magnet of claim 56 where the lanthanum is present in an amount less than one percent of the total rare earth content.

58. The praseodymium-rich anisotropic permanent magnet of claim 47 where the light rare earth is yttrium.

59. The praseodymium-rich anisotropic permanent magnet of claim 58 where the yttrium is present in an amount up to about 10.0 percent of the total rare earth content.

60. The praseodymium-rich anisotropic permanent magnet of claim 59 where the yttrium is present in an amount up to about 5.0 percent of the total rare earth content.

61. The praseodymium-rich anisotropic permanent magnet of claim 60 where the yttrium is present in an amount less than one percent of the total rare earth content.

62. The praseodymium-rich anisotropic permanent magnet of claim 47 where the praseodymium is present in an amount greater than 70 percent of the total rare earth content.

63. The praseodymium-rich anisotropic permanent magnet of claim 62 where the praseodymium is present in an amount between about 70 to about 90 percent of the total rare earth content.

64. The praseodymium-rich anisotropic permanent magnet of claim 47 where the mixture of cerium, lanthanum and yttrium is up to about ten percent of the total rare earth content.

65. The praseodymium-rich anisotropic permanent magnet of claim 47 where heavy rare earth elements are present in a trace amount less than one percent of the total rare earth content.

66. The praseodymium-rich anisotropic permanent magnet of claim 65 where the heavy rare earth elements are selected from the group consisting of dysprosium, gadolinium, samarium, ytterbium, terbium, holmium and mixtures thereof.

67. The praseodymium-rich anisotropic permanent magnet of claim 47 where the impurities present with iron comprise at least one selected from the group consisting of titanium, nickel, bismuth, cobalt, vanadium, niobium, tantalum, chromium, molybdenum, tungsten, manganese, aluminum, germanium, tin, zirconium, hafnium, and mixtures thereof.

68. The praseodymium-rich anisotropic permanent magnet of claim 47 having a maximum energy product of at least 29 MGOe and an intrinsic coercive force of at least 6 kOe.

69. The praseodymium-rich anisotropic permanent magnet of claim 68 where the maximum energy product is greater than 35 MGOe and the intrinsic force is greater than or equal to 8 kOe.

70. A permanent magnet having substantially stable magnetic properties and having as the active magnetic component a sintered product of compacted particulate iron-boron-rare earth intermetallic material, said sintered product having pores which are substantially non-interconnecting, a density of at least 87 percent of theoretical and a composition consisting essentially of in atomic percent about 13 to about 19 percent rare earth elements, about 4 to about 20 percent boron and about 61 to about 83 percent of iron with or without impurities; where the rare earth content is greater than 50 percent praseodymium with an effective amount of a light rare earth selected from the group consisting of cerium, lanthanum, yttrium and mixtures thereof, and balance neodymium.

71. The permanent magnet according to claim 70 where the light rare earth is cerium.

72. The permanent magnet according to claim 71 where the cerium is present in an amount up to about 10.0 percent of the total rare earth content.

73. The permanent magnet according to claim 72 where the cerium is present in an amount up to about 5.0 percent of the total rare earth content.

74. The permanent magnet according to claim 73 where the cerium is present in an amount less than one percent of the total rare earth.

75. The permanent magnet according to claim 70 where the light rare earth is a mixture of cerium and lanthanum.

76. The permanent magnet according to claim 75 where the mixture of cerium and lanthanum is up to about 10 percent of the total rare earth content.

77. The permanent magnet according to claim 70 where the light rare earth is lanthanum.

78. The permanent magnet according to claim 77 where the lanthanum is present in an amount up to about 10.0 percent of the total rare earth content.

79. The permanent magnet according to claim 78 where the lanthanum is present in an amount up to about 5.0 percent of the total rare earth content.

80. The permanent magnet according to claim 79 where the lanthanum is present in an amount less than one percent of the total rare earth content.

81. The permanent magnet according to claim 70 where the light rare earth is yttrium.

82. The permanent magnet according to claim 81 where the yttrium is present in an amount up to about 10.0 percent of the total rare earth content.

83. The permanent magnet according to claim 82 where the yttrium is present in an amount up to about 5.0 percent of the total rare earth content.

84. The permanent magnet according to claim 83 where the yttrium is present in an amount less than one percent of the total rare earth content.

85. The permanent magnet according to claim 70 where the praseodymium is present in an amount greater than 70 percent of the total rare earth content.

86. The permanent magnet according to claim 85 where the praseodymium is present in an amount between about 70 to about 90 percent of the total rare earth content.

87. The permanent magnet according to claim 70 where the mixture of cerium, lanthanum and yttrium is up to about ten percent of the total rare earth content.

88. The permanent magnet according to claim 70 where heavy rare earth elements are present in a trace amount less than one percent of the total rare earth content.

89. The permanent magnet according to claim 88 where the heavy rare earth elements are selected from the group consisting of dysprosium, gadolinium, samarium, ytterbium, terbium, holmium and mixtures thereof.

90. The permanent magnet according to claim 70 where the impurities present with iron comprise at least one selected from the group consisting of titanium, nickel, bismuth, cobalt, vanadium, niobium, tantalum, chromium, molybdenum, tungsten, manganese, aluminum, germanium, tin, zirconium, hafnium, and mixtures thereof.

91. The permanent magnet according to claim 70 having an intermetallic phase with the tetragonal crystalline structure of $RE_2Fe_{14}B$.

92. The permanent magnet according to claim 70 having a maximum energy product of at least 29 MGOe and an intrinsic coercive force of at least 6 kOe.

93. The permanent magnet according to claim 70 where the maximum energy product is greater than 35 MGOe and the intrinsic force is greater than or equal to 8 kOe.

94. The permanent magnet according to claim 70 used for magnet blocks.

95. A sintered permanent magnetic material of an iron-boron-rare earth alloy made in accordance with the following process, comprising: providing an alloy of iron-boron-rare earth in particulate form, said iron, boron, and rare earth being used in amounts substantially corresponding to that desired in the sintered permanent magnetic material and being comprised of a major amount of a iron-boron-rare earth intermetallic phase; aligning the alloy of iron-boron-rare earth in particulate form; pressing and compacting said particulate alloy into a green body; and sintering said green body in a substantially inert atmosphere to produce the sintered permanent magnetic material of the iron-boron-rare earth alloy having a density of at least 87 percent of theoretical with substantially non-interconnecting pores and a composition consisting essentially of, in atomic percent, about 13 to about 19 percent rare earth elements, about 4 to about 20 percent boron and about 61 to about 83 percent of iron with or without impurities, where a rare earth content is greater than 50 percent praseodymium with an effective amount of a light rare earth selected from the group consisting of cerium, lanthanum, yttrium and mixtures thereof, and balance neodymium.

96. The sintered permanent magnetic material of claim 95 where the light rare earth is cerium.

97. The sintered permanent magnetic material of claim 96 where the cerium is present in an amount up to about 10.0 percent of the total rare earth content.

98. The sintered permanent magnetic material of claim 97 where the cerium is present in an amount up to about 5.0 percent of the total rare earth content.

99. The sintered permanent magnetic material of claim 98 where the cerium is present in an amount less than one percent of the total rare earth.

100. The sintered permanent magnetic material of claim 95 where the light rare earth is a mixture of cerium and lanthanum.

101. The sintered permanent magnetic material of claim 100 where the mixture of cerium and lanthanum is up to about 10 percent of the total rare earth content.

102. The sintered permanent magnetic material of claim 95 where the light rare earth is lanthanum.

103. The sintered permanent magnetic material of claim 102 where the lanthanum is present in an amount up to about 10.0 percent of the total rare earth content.

104. The sintered permanent magnetic material of claim 103 where the lanthanum is present in an amount up to about 5.0 percent of the total rare earth content.

105. The sintered permanent magnetic material of claim 104 where the lanthanum is present in an amount less than one percent of the total rare earth content.

106. The sintered permanent magnetic material of claim 95 where the light rare earth is yttrium.

107. The sintered permanent magnetic material of claim 106 where the yttrium is present in an amount up to about 10.0 percent of the total rare earth content.

108. The sintered permanent magnetic material of claim 107 where the yttrium is present in an amount up to about 5.0 percent of the total rare earth content.

109. The sintered permanent magnetic material of claim 108 where the yttrium is present in an amount less than one percent of the total rare earth content.

110. The sintered permanent magnetic material of claim 95 where the praseodymium is present in an amount greater than 70 percent of the total rare earth content.

111. The sintered permanent magnetic material of claim 110 where the praseodymium is present in an amount between about 70 to about 90 percent of the total rare earth content.

112. The sintered permanent magnetic material of claim 95 where the mixture of cerium, lanthanum and yttrium is up to about ten percent of the total rare earth content.

113. The sintered permanent magnetic material of claim 95 where heavy rare earth elements are present in a trace amount less than one percent of the total rare earth content.

114. The sintered permanent magnetic material of claim 113 where the heavy rare earth elements are selected from the group consisting of dysprosium, gadolinium, samarium, ytterbium, terbium, holmium and mixtures thereof.

115. The sintered permanent magnetic material of claim 95 where the impurities present with iron comprise at least one selected from the group consisting of titanium, nickel, bismuth, cobalt, vanadium, niobium, tantalum, chromium, molybdenum, tungsten, manganese, aluminum, germanium, tin, zirconium, hafnium, and mixtures thereof.

116. The sintered permanent magnetic material of claim 95 having an intermetallic phase with the tetragonal crystalline structure of $RE_2Fe_{14}B$.

117. The sintered permanent magnetic material of claim 95 having a maximum energy product of at least 29 MGOe and an intrinsic coercive force of at least 6 kOe.

118. The sintered permanent magnetic material of claim 117 where the maximum energy product is greater than 35 MGOe and the intrinsic force is greater than or equal to 8 kOe.

119. The sintered permanent magnetic material of claim 95 used for magnet blocks.

120. The sintered permanent magnetic material of claim 95 wherein said pressing and compacting of said particulate alloy into a green body is carried out in an aligning magnetizing field.

121. The sintered permanent magnetic material of claim 95 where said sintering temperature ranges from about 950 to about 1200° C.

122. The sintered permanent magnetic material of claim 95 where a heat treatment step follows the sintering for about one to twenty-four hours.

123. The sintered permanent magnetic material of claim 122 where the particle size is up to about 60 microns.

124. The sintered permanent magnetic material of claim 123 where the particle size ranges from about 1 to about 10 microns.

125. The praseodymium-rich anisotropic permanent magnet of claim 47 for use in a magnetic resonance imaging device.

126. The permanent magnet according to claim 70 for use in a magnetic resonance imaging device.

127. The sintered intermetallic product of claim 1 where the effective amount of light rare earth is up to about 30 percent of the total rare earth.

128. The sintered intermetallic product of claim 127 where the effective amount of light rare earth is up to about 10 percent of the total rare earth.

129. The isotropic alloy material of claim 25 where the effective amount of light rare earth is up to about 30 percent of the total rare earth.

130. The isotropic alloy material of claim 129 where the effective amount of light rare earth is up to about 10 percent of the total rare earth.

131. The praseodymium-rich anisotropic permanent magnet of claim 47 where the effective amount of light rare earth is up to about 30 percent of the total rare earth.

132. The praseodymium-rich anisotropic permanent magnet of claim 131 where the effective amount of light rare earth is up to about 10 percent of the total rare earth.

133. The permanent magnet according to claim 70 where the effective amount of light rare earth is up to about 30 percent of the total rare earth.

134. The permanent magnet according to claim 70 where the effective amount of light rare earth is up to about 10 percent of the total rare earth.

135. The sintered permanent magnetic material of claim 95 where the effective amount of light rare earth is up to about 30 percent of the total rare earth.

136. The sintered permanent magnetic material of claim 95 where the effective amount of light rare earth is up to about 10 percent of the total rare earth.

137. The sintered permanent magnetic material of claim 95 for use in a magnetic resonance imaging device.

138. A method for making sintered permanent magnet of an iron-boron-rare earth alloy comprising the steps of:

providing an alloy of iron-boron-rare earth in a particulate form where said particulate has a mean particle size up to about 60 microns, wherein the alloy particulate has a composition consisting essentially of, in atomic percent, about 13 to about 19 percent rare earth elements, about 4 to about 20 percent boron and about 61 to about 83 percent of iron with or without impurities; where the rare earth content is greater than 50 percent praseodymium with an effective amount of a light rare earth selected from the group consisting of cerium, lanthanum, yttrium and mixtures thereof, and balance neodymium;

aligning said particulate in a magnetizing field;

pressing and compacting said particulate alloy into a green body; and sintering said green body in a substantially inert atmosphere to produce a sintered permanent magnet having a density of at least about 87 percent of theoretical and consisting essentially of a substantially intermetallic $RE_2Fe_{14}B$ phase which comprises substantially non-interconnecting pores.

139. A method for making sintered permanent magnet of an iron-boron-rare earth type according to claim 138 where a heat treating step is performed up to twenty-four hours after sintering.

140. A method for making sintered permanent magnet of an iron-boron-rare earth alloy according to claim 138 where the magnet is used in a magnetic resonance imaging device.

141. A permanent magnet made according to the method of claim 138.

142. A metallic powder having a mean particle size up to about 60 microns comprising a composition consisting essentially of about 13 to about 19 atomic percent rare earth, where the rare earth content consists essentially of greater than 50 percent praseodymium, an effective amount of a light rare earth selected from the group consisting of cerium, lanthanum, yttrium and mixtures thereof, and balance neodymium; about 4 to about 20 atomic percent boron; and balance iron with or without impurities.

* * * * *